US005080369A

United States Patent [19]

Mongno

[11] Patent Number: 5,080,369

[45] Date of Patent: Jan. 14, 1992

[54] HOME CONSTRUCTION BOARD GAME

[76] Inventor: Steven R. Mongno, P.O. Box 412, Peapack, N.J. 07977

[21] Appl. No.: 546,740

[22] Filed: Jul. 2, 1990

[51] Int. Cl.[5] ..... A63F 3/00

[52] U.S. Cl. ..... 273/243; 273/276

[58] Field of Search ..... 273/242, 243, 256, 276, 273/278

[56] References Cited

U.S. PATENT DOCUMENTS

| | | | |
|---|---|---|---|
| 2,506,184 | 5/1950 | Twining | 273/276 |
| 4,179,128 | 12/1979 | Zelazny | 273/243 |
| 4,666,162 | 5/1987 | Campbell | 273/276 X |

FOREIGN PATENT DOCUMENTS

| | | | |
|---|---|---|---|
| 3129031 | 2/1983 | Fed. Rep. of Germany | 273/276 |
| 2425873 | 1/1980 | France | 273/276 |
| 2462178 | 3/1981 | France | 273/276 |
| 2582952 | 12/1986 | France | 273/276 |
| 611043 | 6/1946 | United Kingdom | 273/276 |
| 1290171 | 9/1972 | United Kingdom | 273/276 |

OTHER PUBLICATIONS

"Building 'Homes' with Play Money", *Playthings*, Feb. 1960, p. 179.

*Primary Examiner*—Edward M. Coven
*Assistant Examiner*—William E. Stoll
*Attorney, Agent, or Firm*—Kenyon & Kenyon

[57] ABSTRACT

A board gam simulating the construction of a dwelling is disclosed. The game has a board with a sequence of spaces including free spaces, builder/banker spaces, inspection sticker spaces, chance spaces, question spaces, penalty spaces, and a closing space. Players move three-dimensional game tokens representing homes of different styles around the board. Players take turns moving, their movement being governed by the roll of dice. Players receive money from the bank and make payments to the builder by landing on builder/-banker spaces. Additional money can be earned by correctly answering questions relating to dwelling construction when a player lands on a question space. Financial gains and losses are incurred by landing on chance and penalty spaces. Players' progress through the construction process is tracked on a rotary card holder of plot plan cards, a card representing a stage of construction when the previous stage has been completed. The first player to complete all stages and land on the closing space wins the game.

13 Claims, 13 Drawing Sheets

HOME CONSTRUCTION BOARD GAME

BACKGROUND OF THE INVENTION

The invention relates to the art of recreational devices and, more particularly, to a game that simulates the process of constructing a home and that familiarizes players with business, financial, and construction principles involved in the building process.

While there are many educational games that teach players various subjects, applicant is not aware of any game that familiarizes players with the business, financial, and construction principles involved in the process of building a home. Two games that simulate the construction of a home or other structure have been disclosed.

U.S. Pat. No. 2,506,184 to Twining discloses a game that includes game pieces representing components of a house (such as the foundation, body, and roof), a garage, fencing, inhabitants, and pets. These pieces are positioned on a game board. Each player must construct the house and place the other pieces on the player's own game board in their proper sequence (for example, the house foundation must be played before the body). A chance device such as a spinner has spaces with pictorial representations of the game pieces. The players take turns spinning the spinner. A game piece may be played during a player's turn when the spinner points to that piece. The player continues spinning and adding the indicated pieces until the spinner points to a piece that cannot yet be played. The first player to finish his home wins.

Twining describes a game designed to teach children to associates words and pictures with the corresponding playing pieces. Players' progress is dictated purely by chance—each player adds pieces to the house based on the spinner, with no payments or inspection required before advancing.

U.S. Pat. No. 4,179,128 to Zelazny discloses a board game in which each player undertakes construction projects with the goal of maximizing profits. The game consists of a board that is divided into a number of areas each of which correspond to a construction project, such as an apartment building or a parking garage. These areas are further divided into spaces representing the phases of construction (excavation, structural steel work, etc.). Associated with each of these areas on the board are instructions that determine the profit and loss of the player during that step of the construction based on the roll of dice. The players advance through one step of the project each turn. Chance cards that provide additional rewards and penalties are also disclosed. Players undertake one or more projects in parallel or sequentially until all the projects are finished or a set time has expired. The player with the most money at the end of play wins.

The goal of Zelazny's game is to maximize profits rather than to complete construction of a project. Profit and loss depend on the roll of dice, rather than on knowledge of the construction process or factors related to the construction of the project. The players bid on various projects and advance around individual sections of the game board corresponding to each project and therefore do not play on a common course. The game is oriented toward commercial construction projects in general rather than to homes.

Thus, it is evident that there is a need for a game addressed to adults that simulates the construction of a home in a way that familiarizes players with the business, financial, and construction principles involved in the home-building process.

SUMMARY OF THE INVENTION

The present invention meets this need. It is a board game involving the simulated construction of a house that allows individuals to experience the process of building a home. The game provides education about the construction process in a recreational context. The object of the game is to successfully complete from start to finish the various stages involved in the construction of a new home. The player who builds and closes on a home first wins the game.

The game include playing pieces that are three-dimensional replicas of the players' completed homes and plot plans corresponding to each of the available house floor plans, with each plot plan having a rotary card holder with cards that are flipped over as the player completes each stage of the construction process. These cards provide a visual representation of the progress being made on the building of the players' homes and indicate when inspections are required and various payments are due.

The number of spaces a player moves on the board is determined by the roll of dice. The game board is composed of a number of playing spaces through which players advance tokens. As players move around the board they land on different types of spaces which include free spaces, chance spaces, penalty spaces, question spaces, inspection sticker spaces, builder/banker spaces, and the closing space. Question spaces are those spaces that allow players to earn extra money by correctly answering questions relating to the building process and economic factors that affect the home construction industry. Chance and penalty spaces provide additional monetary profits or losses associated with the building process. Inspection sticker spaces present opportunities for players to progress on the home by completing a phase of the construction process. Players receive money from the bank and make payments to the builder on the builder/banker spaces. The first player to land on the closing space after passing all required inspections and making all required payments wins the game. Free spaces do not affect the play of the game, but can provide information about the building process.

DETAILED DESCRIPTION

The object of the game is to successfully complete from start to finish the various stages involved in the construction of a new home. The player who builds and closes on a home first is the winner of the game.

The basic components of the game are the playing pieces; the plot plan; the dice; the board; the question cards; the chance cards; and the currency.

Figure 4A:
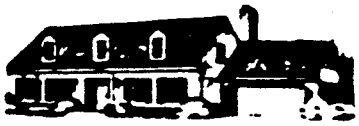
FIGS. 4A-4D are perspective views of the three-dimensional playing pieces that players move around the board.
Figure 4B:
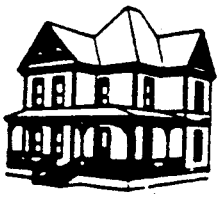
Figure 4C:
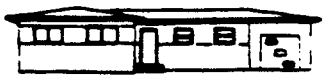
Figure 4D:
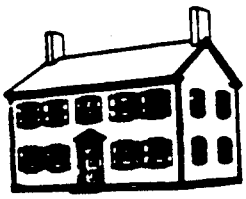

The game is designed to take each player through the building of a $100 a square foot, 2,400 square foot or $240,000 custom home. Other embodiments of the game may involve the building of larger more expensive homes; such embodiments therefore require greater skill and knowledge of the building process. Each player selects a house floor plan, with the choice represented by the playing piece selected. As shown in FIG. 4, the playing pieces are three dimensional replicas of the player's completed home. There are four models to select from: a Cape Cod (FIG. 4A); a Victorian (FIG. 4B); a Ranch (FIG. 4C) and a Colonial (FIG. 4D). These models can be varied depending upon the area of the country in which the game is sold to reflect particular geographic preferences for certain styles.

Figure 5:
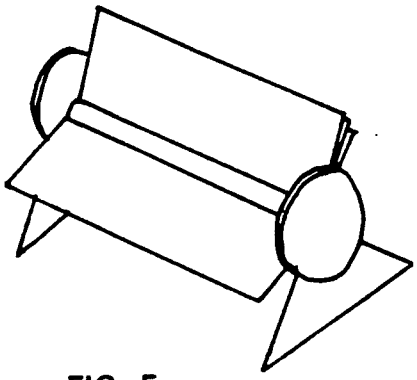
FIG. 5 is a perspective view of the rotary card holder used to hold the plot plan cards
Figure 6:
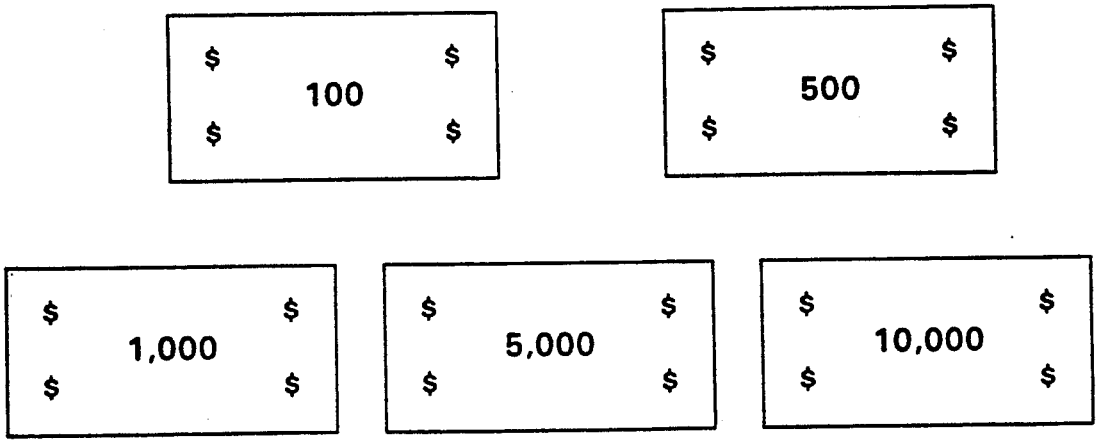
FIG. 6 shows the simulated currency used in the game.

A plot plan is provided that corresponds to the floor plan selected by each player. As shown in FIG. 5, the plot plan consists of a rotary card holder of cards that are flipped over as the player completes each stage of the game. These cards provide a visual representation of the progress being made on the building of the player's home.

The cards also instruct the players to go to the bank to obtain payments owed to the builder and to make payments to the builder. The order of the cards and their contents are as follows.

Figure 2A:
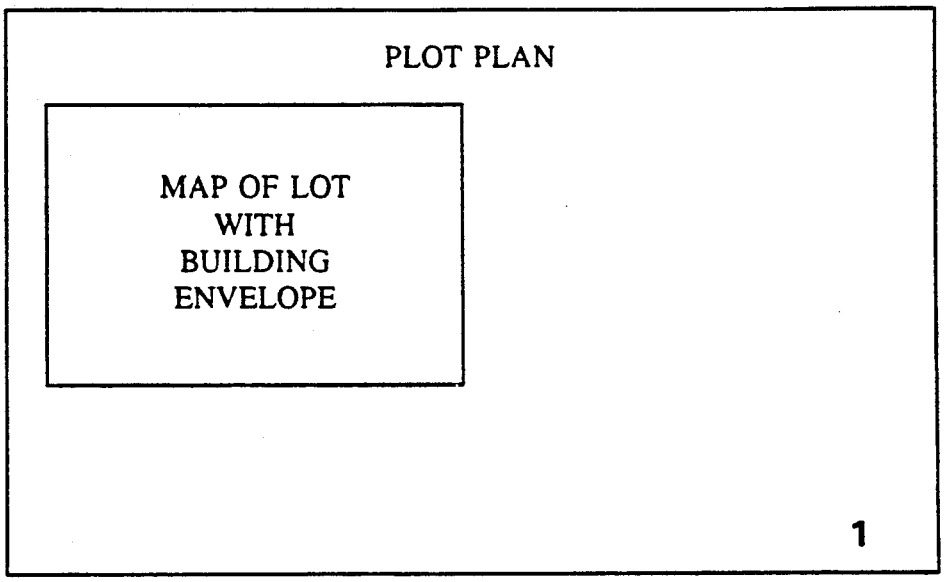
FIGS. 2A-2F and 3A-3D show plot plan cards used to mark a player's progress through the game.

The first card, as shown in FIG. 2A, is the plot plan. The card shows a map of the lot with the building envelope. This card also instructs the player to visit the bank to obtain the first payment of $40,000 for the builder. The player is then instructed to move toward the next builder/banker space to pay the builder so that the builder can begin work on the home.

Figure 2B:
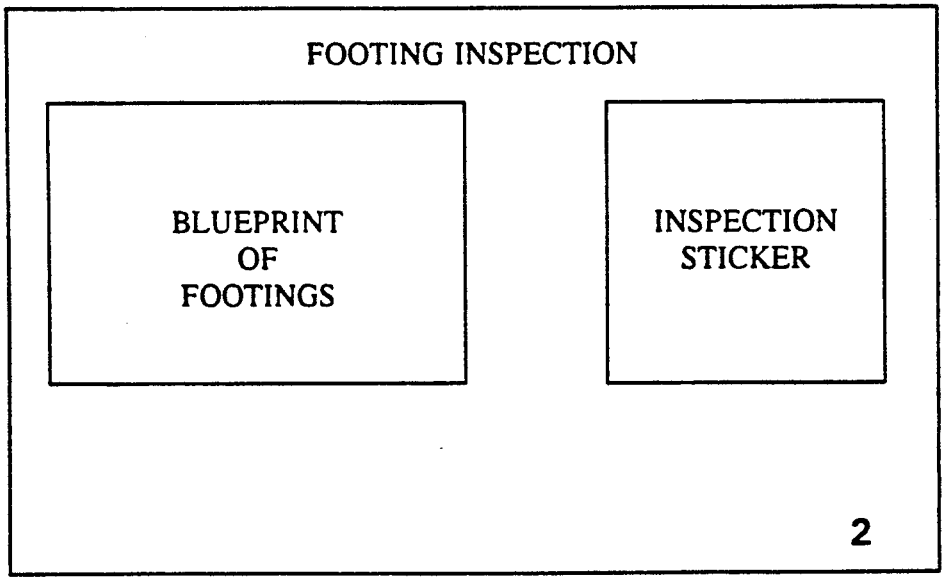

The second card, shown in FIG. 2B, displays a footing inspection sticker and an elevation of the footings.

Figure 2C:
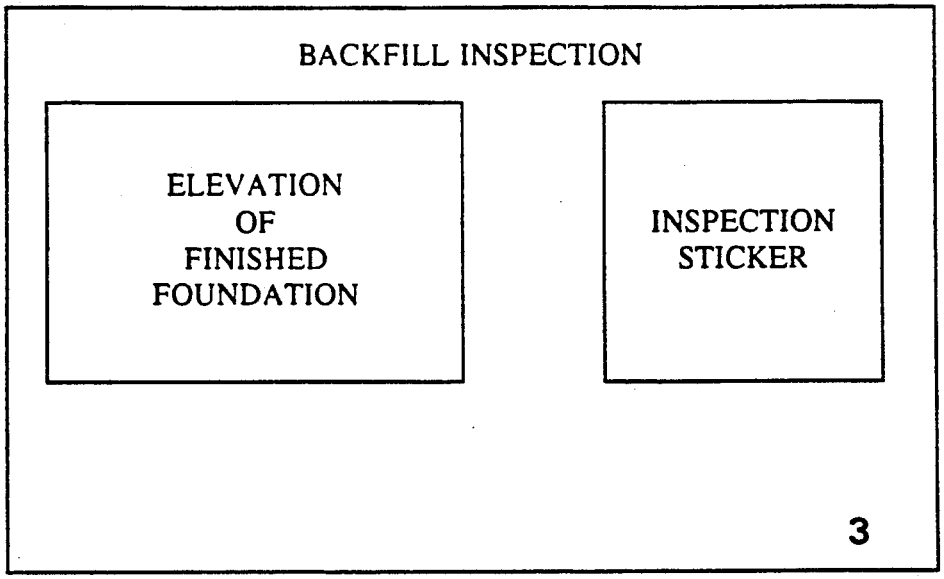

The third card, shown in FIG. 2C, displays a backfill inspection sticker and the elevation of the finished foundation.

Figure 2D:
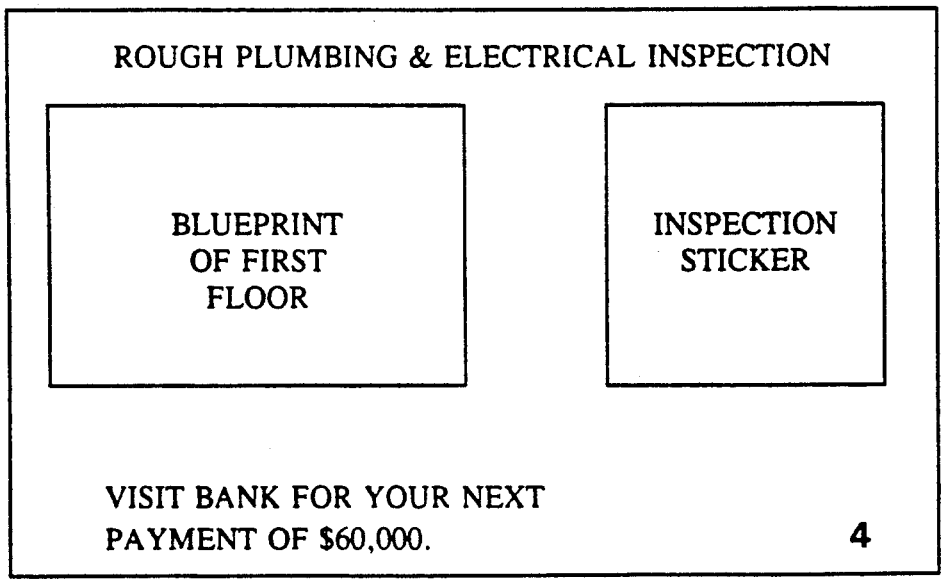

The fourth card, shown in FIG. 2D, displays a rough plumbing and electrical inspection sticker and a blueprint of the first floor of the house. This card instructs the player to visit the bank to obtain the second payment of $60,000 for the builder.

Figure 2E:
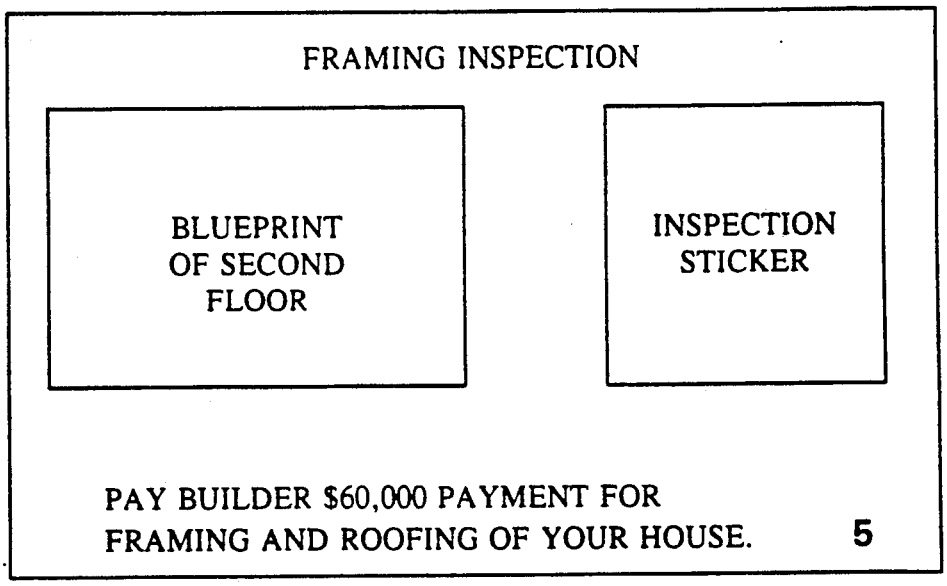

The fifth card, shown in FIG. 2E, displays a framing inspection sticker and a blueprint of the second floor. This card instructs the player to pay the builder the second payment of $60,000 for the framing and roofing of the house.

Figure 2F:
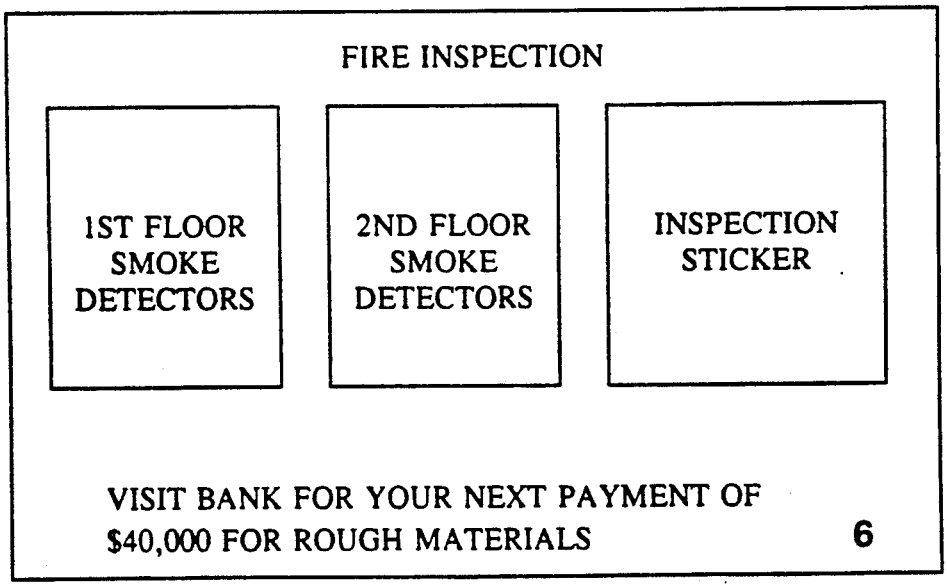

The sixth card, shown in FIG. 2F, displays a fire inspection sticker and a floor plan with smoke detectors. This card instructs the player to visit the bank to obtain the third payment of $40,000 for the installation of the rough plumbing and electrical mechanisms in the house.

Figure 3A:
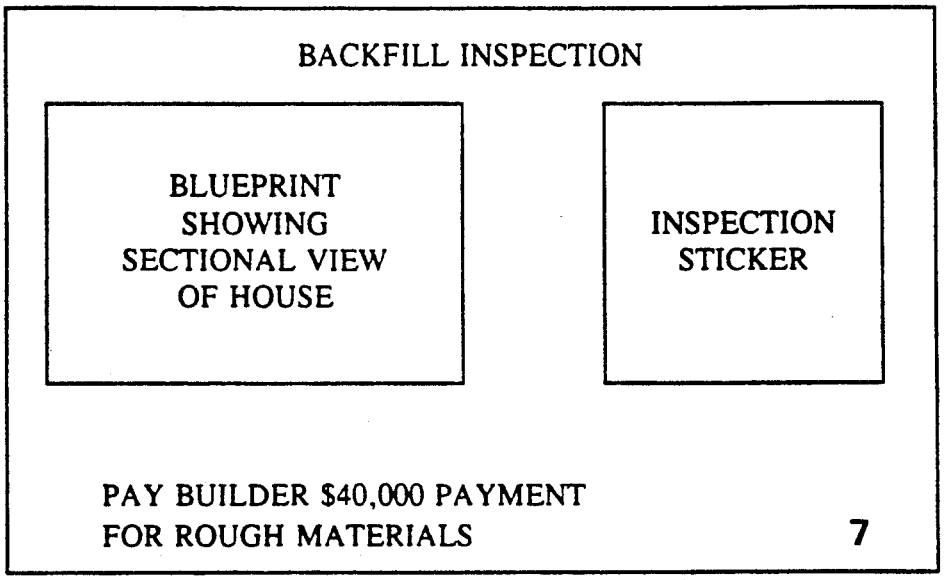

The seventh card, shown in FIG. 3A, displays an insulation inspection sticker and a blueprint showing a sectional view of the house. This card instructs the player to pay the builder $40,000 for the completion of the rough plumbing and electrical mechanisms in the house.

Figure 3B:
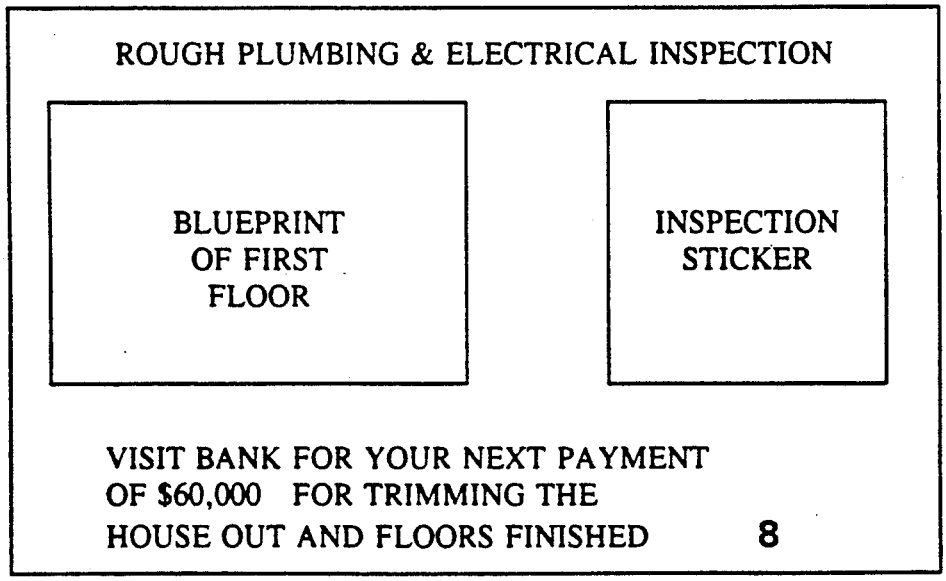
Figure 3C:
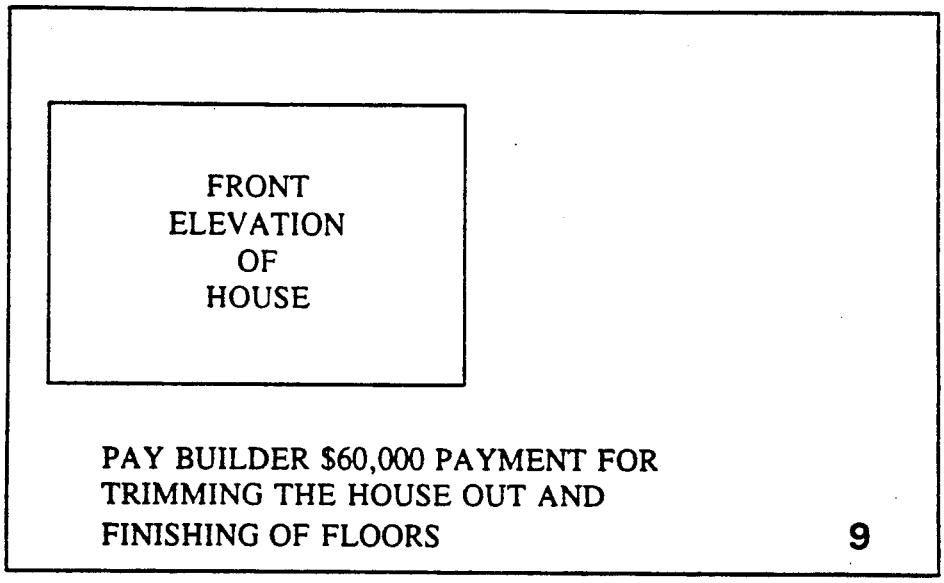

The eighth card, shown in FIG. 3B, displays a final plumbing and electrical inspection sticker and an interior elevation of a bathroom. This card instructs the player to visit the bank to obtain the fourth payment of $60,000 for the trimming out of the house and the finishing of the floors The ninth card, shown in FIG. 3C, displays a front elevation of the house. This card instructs the player to pay the builder $60,000 for trimming out and finishing the floors of the house.

Figure 3D:
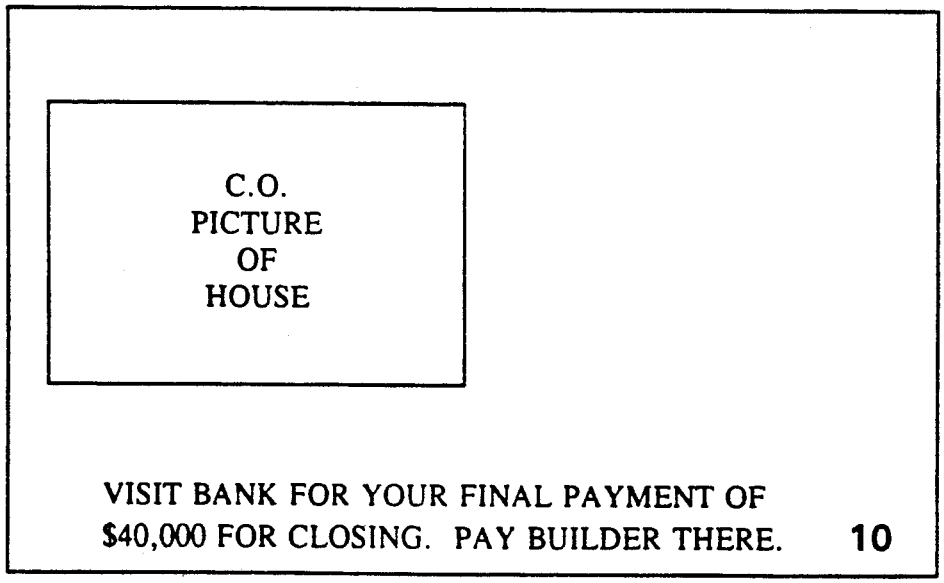

The tenth card, shown in FIG. 3D, displays a picture of the completed house. This card instructs the player to visit the bank to obtain the final payment of $40,000 for the closing. The builder receives this payment when the player lands on the closing space.

The game board spaces can form the basic outline of a house floor plan. In the embodiment shown in FIGS. 1A-1E, the board spaces are arranged in a hollow square. The board spaces are further divided into the various stages of building a home. These stages are: pouring the footings; putting in the backfill; framing the first floor an installing rough plumbing; framing the second floor and installing rough electricals; the completed framing; installing the fireplace and the roof; closing in the house and installing insulation; installing the final plumbing and final electrical work; and the painted, finished home.

A conventional pair of dice are used for movement around the board. Other random-number generating means such as spinners could be used. As the players go around the board, there are different types of spaces that the players land on. These types of spaces are free spaces, penalty spaces, question spaces, chance spaces, inspection sticker spaces, builder/banker spaces, and, finally, the closing space.

Figure 1A:
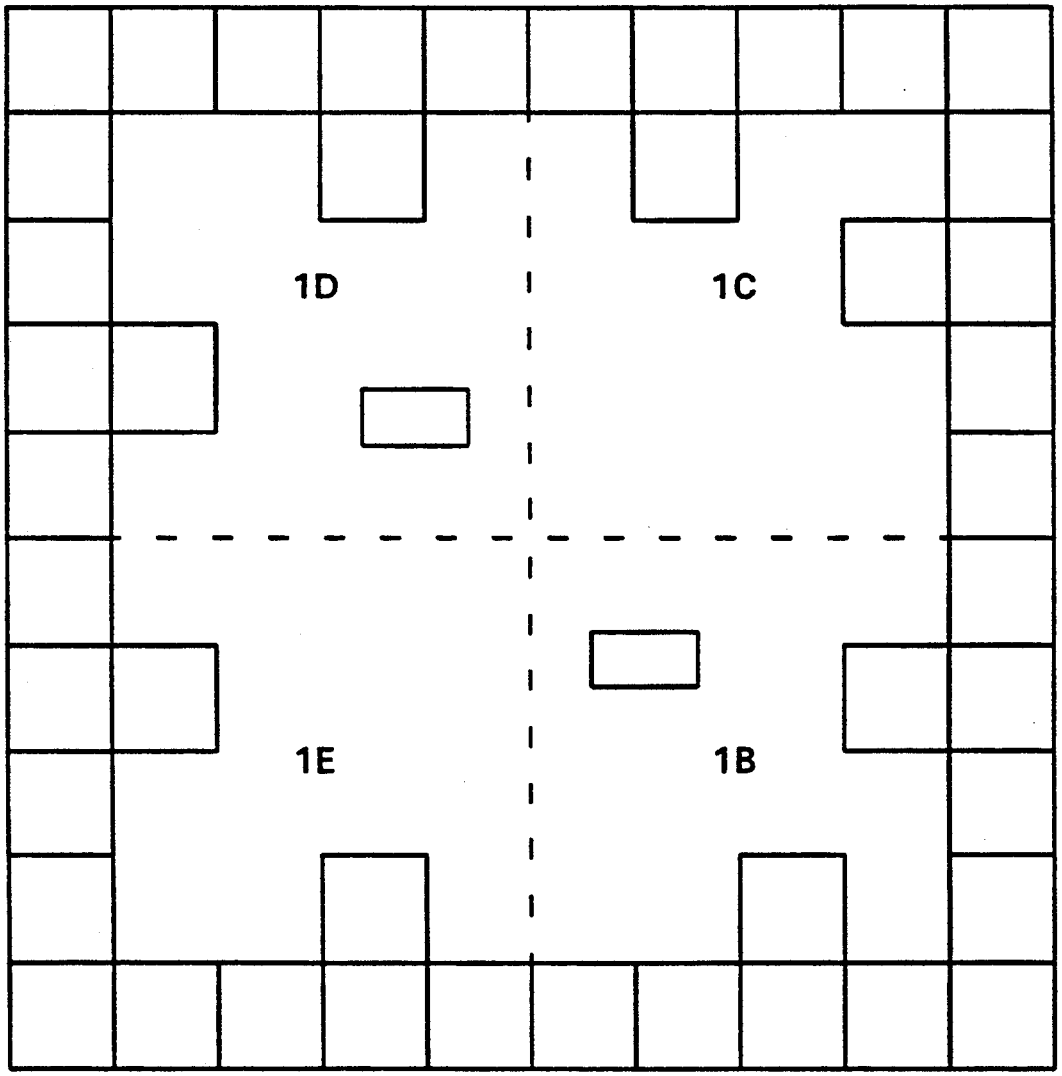
FIGS. 1A-1E are overall and partial plan views of a game board employed in the described embodiment of the invention.
Figure 1B:
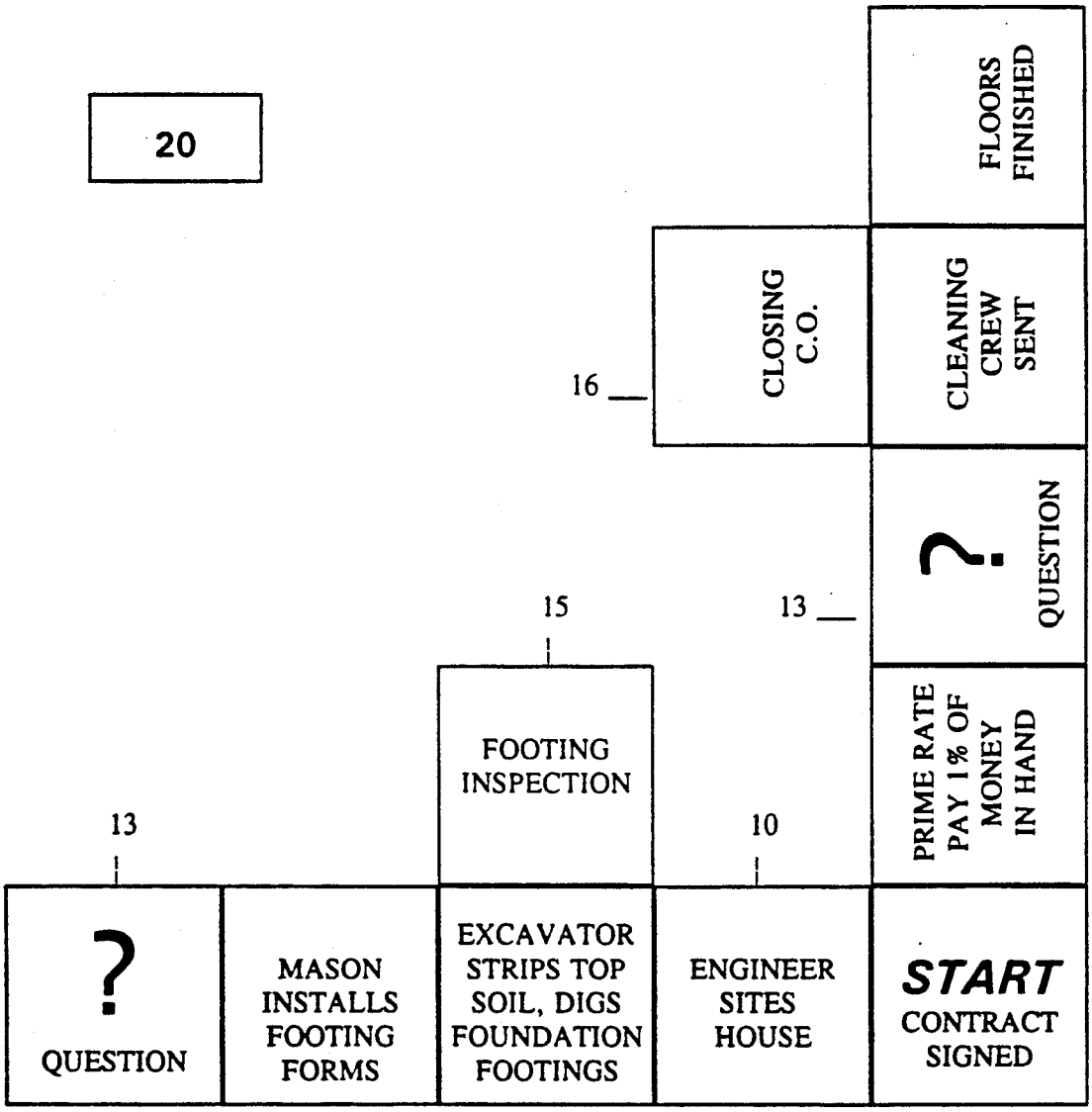

When a player lands on a free space, such as space 10 in FIG. 1B, the player is on a safe space and is merely provided with information about different steps in the building of a home.

Figure 1C:
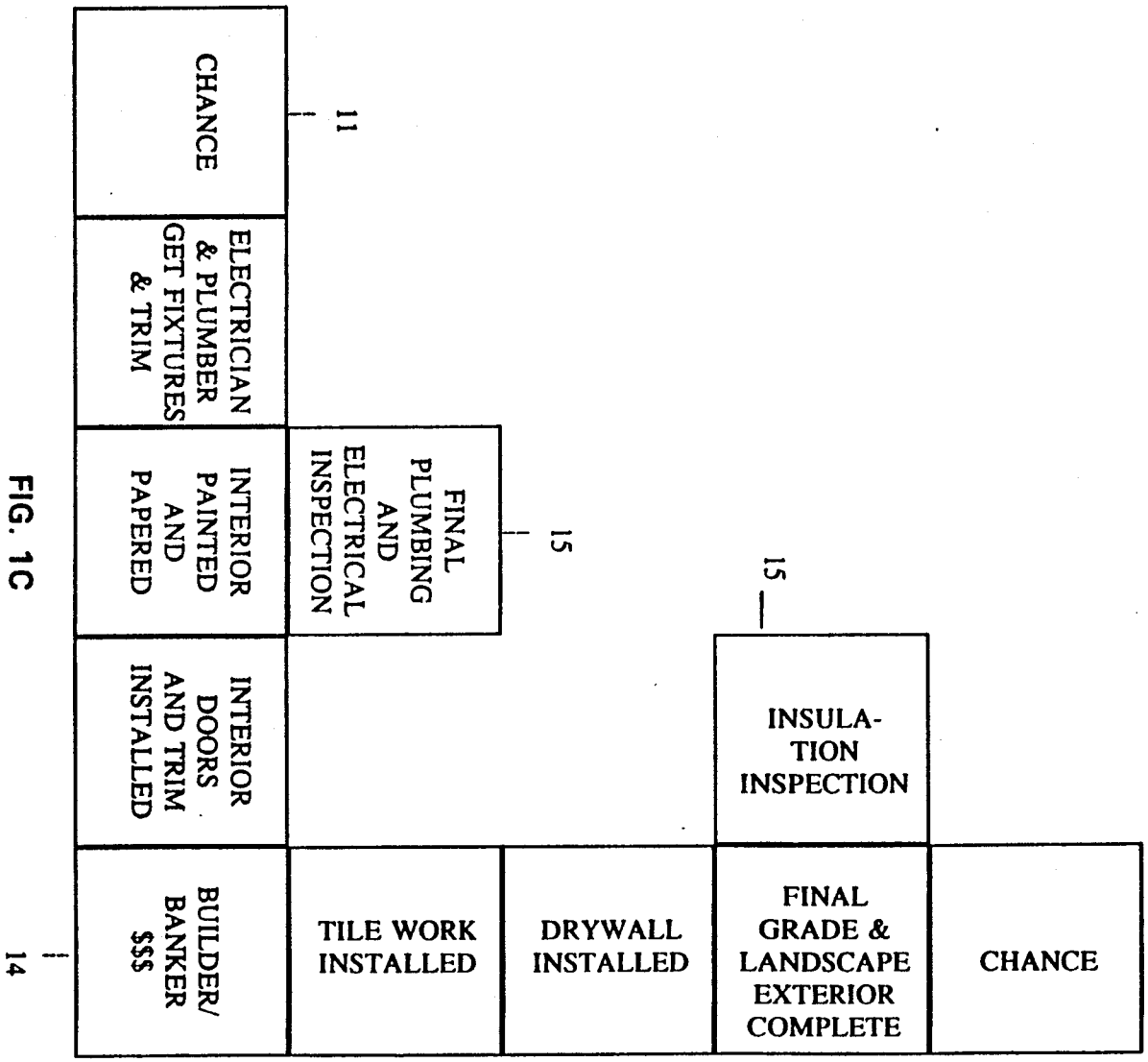
Figure 7B:
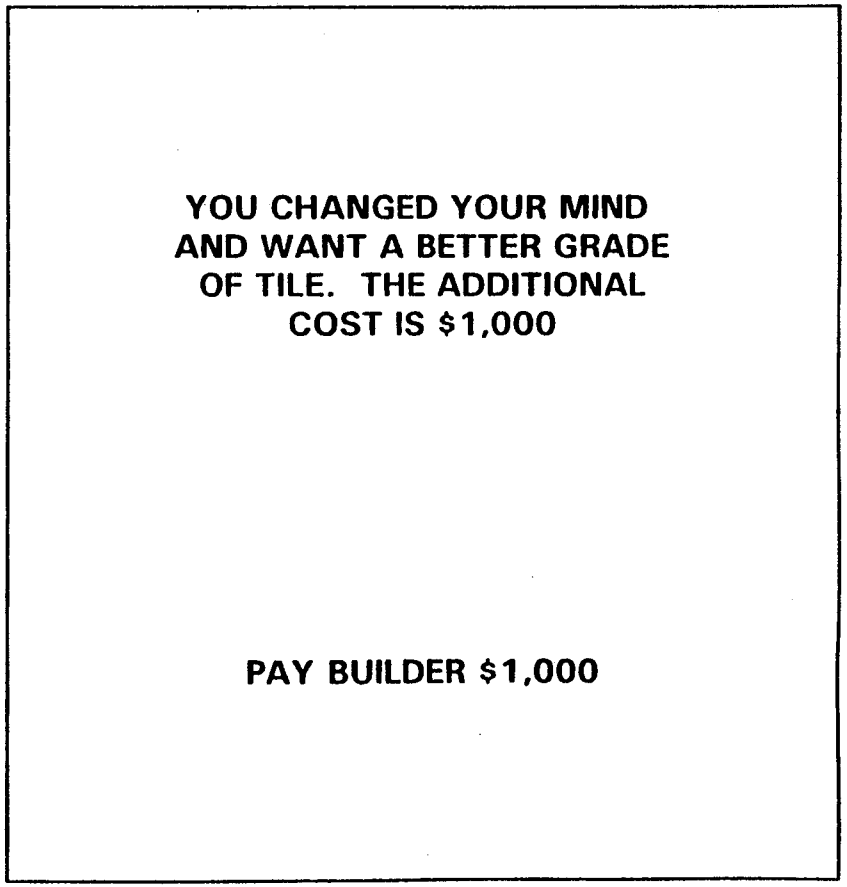
FIGS. 7A and 7B show the front and back, respectively, of a chance card.
Figure 7A:
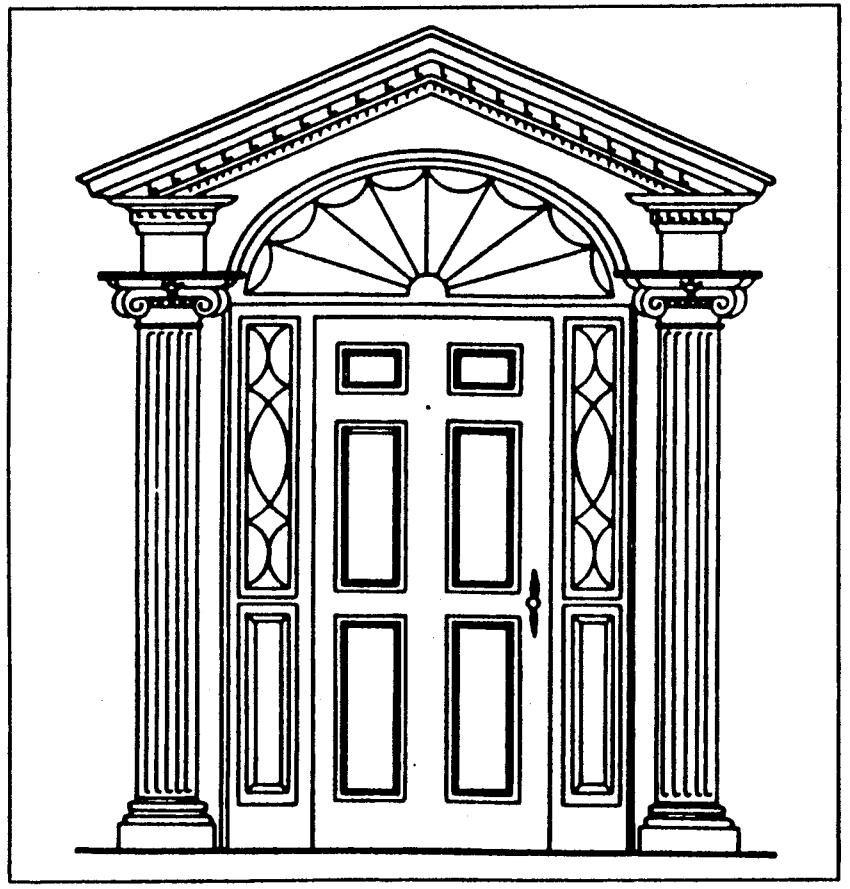

When a player lands on a chance space, shown as space 11 in FIG. 1C, the player takes the top chance card from the deck 20 of chance cards kept on the board and complies with the instructions on the card. The card will be either some type of penalty, such as a delay in the construction of the house or payment of an unanticipated expense, or a financial benefit such as a bonus. A sample chance card is shown in FIG. 7. The front side of the cards are as shown in FIG. 7A, while the back of a sample card is shown in FIG. 7B.

Figure 1D:
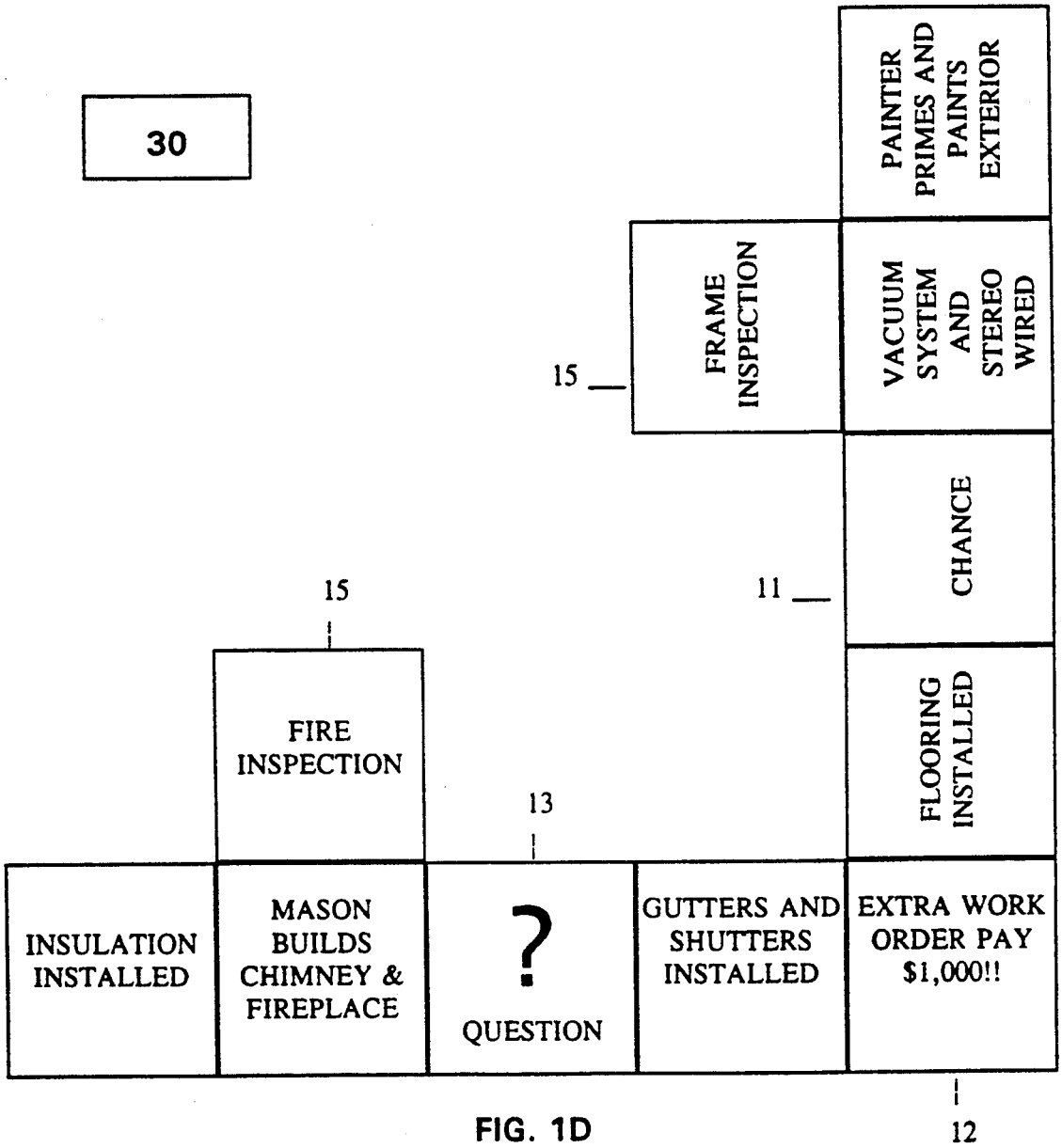
Figure 1E:
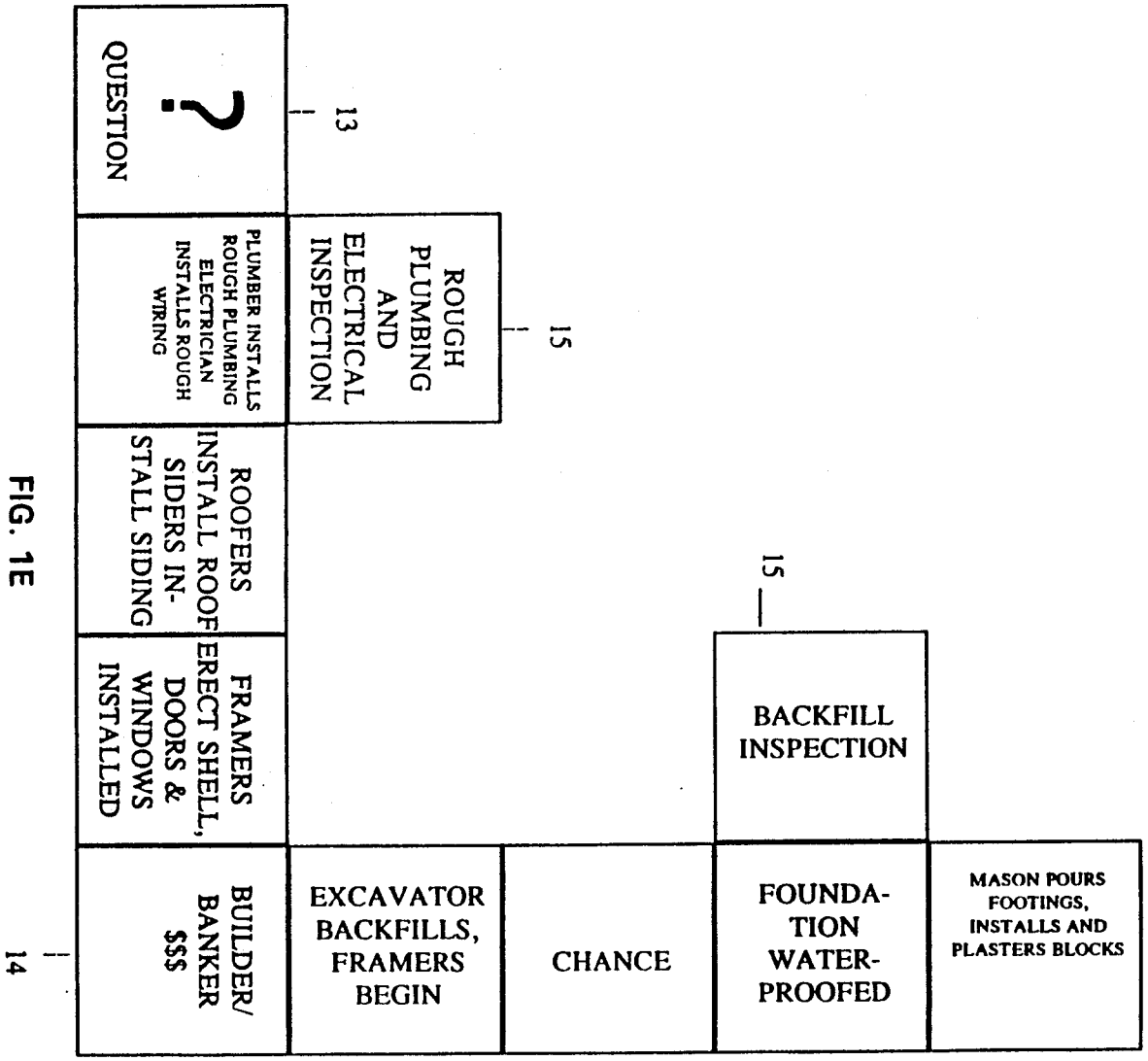

When a player lands on a penalty space, such as space 12 shown in FIG. 1D, the player incurs some type of financial penalty such as "extra workorder, pay $1,000."

Figure 8B:
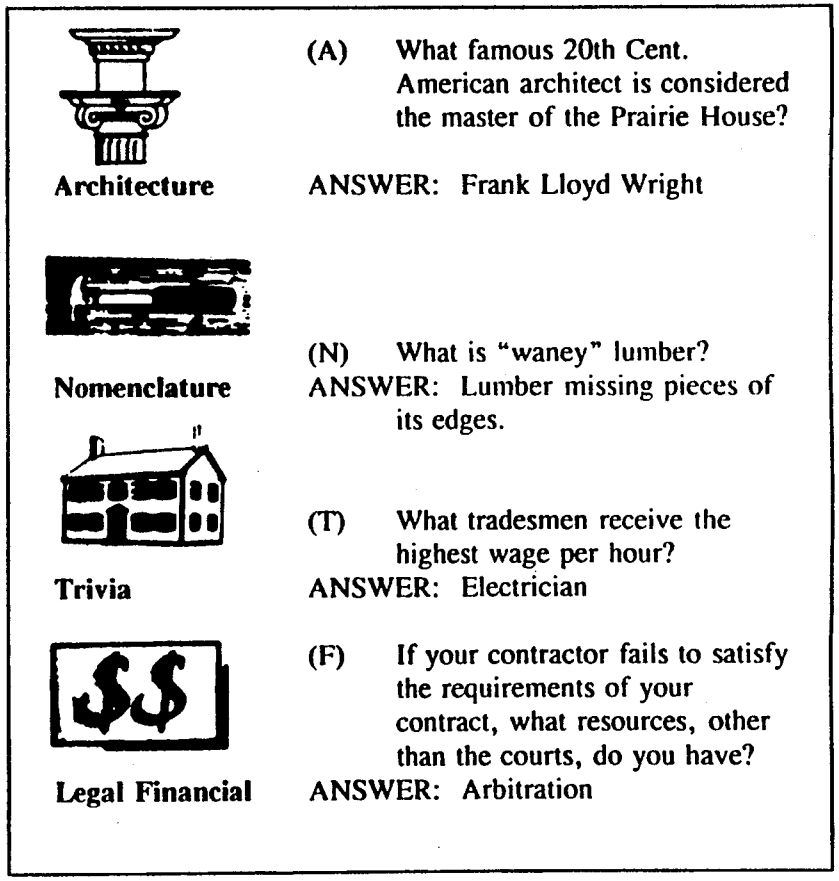
FIGS. 8A and 8B show the front and back, respectively, of a question card.
Figure 8A:
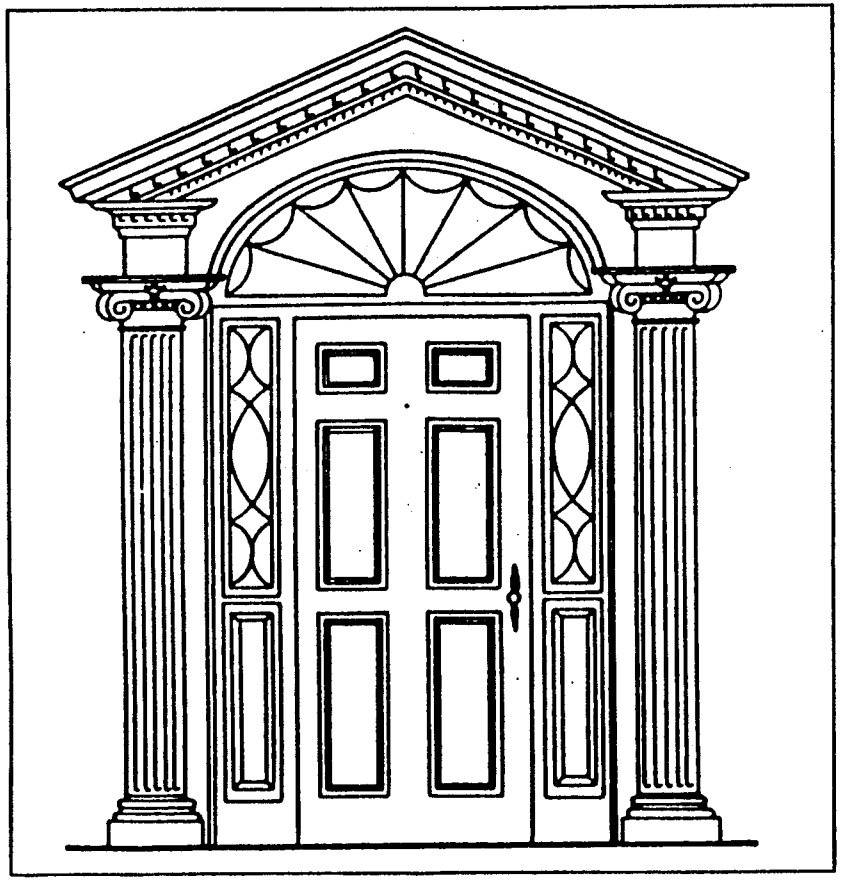

When a player lands on a question space, shown as spaces 13 in FIG. 1B, the player takes the top question card from the deck 30 of question cards that are kept on the board. On each question card are four questions, one in each of four categories: architecture; building nomenclature; building trivia; and banking/finance. The front side of the question cards is shown in FIG. 8A. As shown in FIG. 8B, the back of each card lists the questions and the correct answer to each question. An opposing player reads the questions to the player who lands on the space. For each correctly answered question, the player will receive a $250 bonus. If the player answers each of the four questions on the card correctly the player receives $1,000. After answering the questions, the player returns the card to the bottom of the deck.

When a player lands on a builder/banker space, shown as spaces 14 in FIGS. 1B, and 1D, the player can receive money from the bank for payments to the player's builder or make payments to the player's builder for work completed on the player's house. Although the builder and banker share the same space on the board, players cannot make payments to the builder on the same space where the player has just received money from the bank to make the payment. The player must move to the next builder/banker space to make the payment. The only exception to this rule occurs when a player has drawn a chance card specifying that payment from the bank and payment to the builder can be made on the same builder/banker space. If a player fails to roll the number required to land on the needed builder/-banker space, the player may forfeit one or more turns until the player rolls the required number.

Players must land on seven consecutive inspection sticker spaces, shown as spaces 15 in FIGS. 1B–1E, during the game. To successfully close on a home, a player must have received an inspection sticker for each stage of the building process requiring an inspection. Players can obtain inspection stickers only when they land on an inspection sticker space. Once a player receives an inspection sticker for one stage of the building process, the player may flip to the next plot plan card in the rotary card holder and work on the next stage of construction.

Although a player must land on the inspection sticker spaces in order, if a player fails to land on one of these spaces when completing a particular phase of the house's construction, the player can continue around the board earning money and return to that construction phase on the next circuit around the board to attempt again to land on the appropriate inspection sticker space. If a player fails to roll the number required to land on the needed inspection sticker space, the player may forfeit one or more turns until the player rolls the required number.

The first player who lands on the closing space 16 after passing all of the inspections and making all payments to the builder is the winner of the game. When a player lands on the closing space before obtaining all inspection stickers and making all payments, the closing space is treated as a free space.

The players receive money to make payments with the currency shown in FIG. 7.

To begin play each player rolls the dice. The player with the highest roll begins the play. The next highest roll follows and so on until the playing order is established for everyone. The players also roll the dice to determine the number of moves they can make on the board when their turns occur.

Throughout the course of the game, players are required to obtain various payments from the bank to be made to the builder. The total amount of money each player receives from the bank is $240,000. One player is designated the "builder/banker". The banker issues payments and bonuses to players and accepts penalty payments from players. When acting as the builder, this player accepts each of the five payments which the players must make during the course of the game. Players start the game with no money, but can earn money by correctly answering questions when landing on the question spaces or by earning bonuses from chance spaces.

Each player selects a house floor plan with the choice represented by the plot plan and playing piece selected.

The object of the game is to successfully complete from start to finish the various stages involved in the construction of a new home. The player who builds and closes on a home first is the winner of the game. To do so, the player must land on each of the seven inspection sticker spaces in consecutive order. After landing on each consecutive inspection sticker space, the player must then advance to the next stage of construction and its corresponding inspection sticker space. Each player must also make five payments to the builder during the course of the game.

The players begin the game with their lots already paid for. During the course of the game, each player will build and pay for a $240,000 home. The players must meet the following schedule of payments to the builder. Payment 1 is a $40,000 payment due at the start of the game upon signing the contract with the builder. Payment 2 is a $60,000 payment due to the builder after the framing inspection. Payment 3 is a $40,000 payment due to the builder after the house is closed in and rough electrical and plumbing mechanisms have been installed. Payment 4 is a $60,000 payment due to the builder after the house is trimmed out and the floors are finished. Payment 5 is a $40,000 payment due to the builder at closing.

Each player must go to the bank five times during the game to obtain the money for each of these payments to the builder. The plot plan, as well as spaces on the board, instruct players when to go to the bank to obtain the money for payments and when payments must be made to the builder. If a player has insufficient funds to make a payment, the player can continue around the board to raise additional money to make a payment. This additional money is raised via bonuses from question and chance spaces.

To begin the game, each player rolls the dice. The player with the highest roll places his or her playing piece on the start space, rolls the dice, and moves toward the bank to obtain the money to make the first $40,000 payment to the builder. When a player's turn is completed, the player passes the dice to the player with the next highest roll and so on until each player has had a turn.

When the player lands on the builder/banker space, the bank pays the player the first $40,000 payment. The player must then move the playing piece to the next builder/banker space to make the payment to the builder. The player then moves the playing piece back to the start space and actually begins the construction of the home by moving toward the first inspection sticker space.

What is claimed is:

1. A game representing the construction of a dwelling, said game comprising:

a. a game board having a plurality of playing spaces, said playing spaces including one or more spaces labeled as building/banker spaces and one or more spaces labeled as inspection sticker spaces, each of said inspection sticker spaces indicating one of a plurality of stages in the process of constructing a dwelling, each of said construction process stages having an associated cost as indicated by the game indicia, a plurality of said construction process stages having an indicated inspection requirement;

b. means for generating random numbers;

c. a plurality of visually distinguishable game tokens, one for each player, said tokens marking the location of a player on said game board;

d. simulated currency;

e. a plurality of sets of plot plan cards, each of said sets of plot plan cards corresponding to one of said game tokens and comprising a plurality of plot plan cards, each of said plot plan cards indicating one of said construction process stages, said plot plan cards being arranged within said set of plot plan cards in the order in which said construction stages occur in the construction of a dwelling; and f. means for holding each of said sets of plot plan cards for selective display of a single plot plan in each set.

2. The game of claim 1 wherein said playing spaces include one or more spaces labeled as question spaces and further comprising a plurality of questions cards, each of said question cards containing questions relating to the construction of a dwelling.

3. The game of claim 2 wherein said playing spaces include one or more spaces labeled as chance spaces and further comprising a plurality of chance cards providing selected rewards and penalties.

4. The game of claim 3 wherein said playing spaces are arranged in an order generally corresponding to the chronological order in which a dwelling is constructed.

5. The game of claim 4 wherein said playing spaces are contiguously arranged in a geometry representing a floor plan of a house.

6. The game of claim 4 wherein said playing spaces are contiguously arranged in a hollow square.

7. The game of claim 6 wherein said game tokens are representations of houses, each of said game tokens representing a different style of house.

8. The game of claim 7 wherein the number of said tokens is four and a first of said tokens represents a Cape Cod-style house, a second of said tokens represents a Victorian-style house, a third of said tokens represents a Ranch-style house, and a fourth of said tokens represents a Colonial-style house.

9. The game of claim 6 wherein said plot plan card set holding means is a rotary card holder.

10. The game of claim 9 wherein said radome number generating means is a pair of dice.

11. A method for playing a game representing the construction of a dwelling, said method comprising the steps of:

a. a plurality of players moving a plurality of visually distinguishable game tokens, one for each player, around a game board having a plurality of playing spaces including one or more spaces labeled as building/banker spaces and one or more spaces labeled as inspection sticker spaces, each player moving one of said game tokens according to numbers generated by a random-number generator;

b. each player making payments with simulated currency for each of a plurality of stages of the process of constructing a dwelling, as indicated by the game indicia, each of said construction process stages having an indicated cost and a plurality of said construction process stages having an indicated cost and a plurality of said construction process stages having an indicated inspection requirement, each player selectively making a payment upon moving the game token moved by said player to a spaced labelled as a builder/banking space;

c. each player receiving payments of simulated currently for each of said construction process stages, each player selectively receiving a payment upon moving the game token moved by said player to a spaced labelled as a builder/banker space;

d. each player satisfying each of said inspection requirements associated with a plurality of said construction process stages by moving the player's game token to one of said spaces labeled as inspection sticker spaces;

e. each player selectively displaying one of a plurality of plot plan cards, each of said plot plan cards indicating one of said construction process stages, said plot plan cards being arranged in an order corresponding to the order in which said construction process stages occur in the construction of a dwelling, each player displaying a plot plan card when said player has paid the construction cost indicating by the next preceding plot plan card and, where applicable, landed on the inspection sticker space corresponding to the inspection requirement for the next preceding plot plan card; and f. one of said players first displaying the last of said plot plan cards.

12. The method of claim 11 wherein said playing spaces include one or more spaces labeled as question spaces and further comprising the step of each player who moves the player's token to one of said question spaces drawing one of a plurality of question cards and responding to each of a plurality of questions relating to construction of a dwelling and receiving a predetermined quantity of said simulated currency for correctly answering each of said questions.

13. The method of claim 12 wherein said playing spaces include one or more spaces labeled as chance spaces and further comprising the step of each player who moves the player's token to one of said chance spaces drawing one of a plurality of chance cards and receiving or paying a predetermined quantity of simulated currency according to instructions on said chance card.

* * * * *